United States Patent [19]

Jensen et al.

[11] Patent Number: 4,880,322

[45] Date of Patent: Nov. 14, 1989

[54] METHOD FOR REBOUND DAMPING OF PRINT HAMMER MAGNETS IN TYPEWRITERS OR SIMILAR OFFICE MACHINES

[75] Inventors: Christian Jensen, Nuremberg; Gunther Schmidt, Schnaittenbach, both of Fed. Rep. of Germany

[73] Assignee: TA Triumph-Adler Aktiengesellschaft, Nuremberg, Fed. Rep. of Germany

[21] Appl. No.: 195,783

[22] Filed: May 5, 1988

[30] Foreign Application Priority Data

Nov. 20, 1987 [DE] Fed. Rep. of Germany ..... 3739295

[51] Int. Cl.[4] ..... B41J 9/42

[52] U.S. Cl. ..... 400/167; 400/157.2; 101/93.48

[58] Field of Search ..... 101/43.02, 43.03; 400/157.2, 157.3, 167; 361/153, 154

[56] References Cited

U.S. PATENT DOCUMENTS

| | | | |
|---|---|---|---|
| 3,909,681 | 9/1975 | Campari et al. | 361/154 |
| 4,291,992 | 9/1980 | Barr et al. | 400/167 |
| 4,538,930 | 9/1985 | Dunfield | 400/157.2 |
| 4,659,969 | 4/1987 | Stupak | 361/154 |
| 4,679,116 | 7/1987 | Oshizawa et al. | 361/154 |

*Primary Examiner*—Paul T. Sewell
*Assistant Examiner*—Steven S. Kelley

[57] ABSTRACT

A method of damping the rebound in print hammer magnets in typewriters or similar office machine in which kinetic energy is removed, in a manner known per se, from the armature of the print hammer magnet returning to its initial position by charging the coil of the print hammer magnet with a so-called braking pulse. The method provides the charging of the coil of the print hammer magnet with measuring pulses during the time when it returns into its initial position and to measure the current flowing through the coil. The increase in current depends on the width of the air gap and therefore permits conclusions as to the position of the armature, so that the braking impulse can be switched on at the correct time.

2 Claims, 4 Drawing Sheets

A
B

I ≥ I ref 2
NO
YES
SET COUNTER TO 1
SWITCHING MEASURING PULSE ( U1 ; t7 ) TO COIL 2
INCREMENT COUNTER BY 1
MEASUREMENT OF CURRENT "I" THROUGH COIL 2
I ≥ I ref 1
NO
YES
OBTAINING t 3 FROM ROM I ;
START t3 ;
CONVERT CONTENT OF COUNTER VIA ROM TABLE TO TIME t 2
C

METHOD FOR REBOUND DAMPING OF PRINT HAMMER MAGNETS IN TYPEWRITERS OR SIMILAR OFFICE MACHINES

BACKGROUND OF THE INVENTION

1. Field of the Invention

The invention relates to a method of damping the rebound of print hammer magnets in typewriters or similar office machines, where the typewriters or similar office machines have a programmable control unit consisting of at least a microprocessor as well as a memory preferably divided into a ROM and a RAM and where the printing of a character is accomplished by charging the print hammer magnet with a specified first voltage curve $U_1$ over a specified first time $t_1$ and the damping of the rebound is accomplished by a braking pulse with a specified second voltage curve $U_2$ over a specified second time $t_2$ by means of the control unit 2. The Prior Art Machines of the type dealt with in this application often have so-called adding print members, the characters of which are individually accelerated in the direction of the platen by means of a printing hammer magnet and thus make an impression in a known manner. Control of the printing hammer magnet in the known machine is done by means of a programmable control unit which customarily consists of at least one microprocessor and a memory, the memory being divided into a ROM containing the control programs and a RAM receiving the variable data. Depending on the character size the microprocessor controls a drive circuit which charges the coils of the printing hammer magnet with a specified voltage for a specified time. In this way a uniform print format regardless of character size is assured.

In connection with print hammer magnets a problem arises in that the armature of the print hammer magnet returns to its initial position with very high kinetic energy after the actual impression. Therefore steps must be taken to absorb this kinetic energy in such a way that both the noise generation and the damping period of the armature are minimized.

To solve this problem it is known, aside from the use of mechanical damping means, to achieve damping by charging the coil of the print hammer magnet with a braking pulse. For example, it is proposed in German Laid-open Application DE OS No. 26 45 498 to have the printing hammer magnet accelerate the characters towards the platen with variable speeds, depending on the character size. The variation in speed is achieved by a variation in the voltage with which the coils of the printing hammer magnet are charged. To damp the rebound in proportion to character size it is further proposed to brake the armature returning to its initial position by charging the coil of the printing hammer magnet with a percentage of the acceleration voltage. This method assures that a satisfactory rebound damping is achieved when the printing hammer magnet is charged with a braking pulse at the correct time. However, this correctly timed charging is highly problematical since, depending on the mechanical conditions, the entire repulsion procedure requires various amounts of time.

For the correctly timed pick-up of the braking pulse, German Patent DE PS 31 16 402 discloses a device which determines, by means of a sensor, for example in the form of a photoelectric barrier, the time when the returning armature of the print hammer magnet passes a specified point in its path. After a specified delay time the coil of the print hammer magnet is charged with the braking pulse. Although it is possible to provide the print hammer magnet with the braking pulse in a correctly timed manner by means of this device, this can only be achieved by the use of a relatively expensive sensor.

SUMMARY OF THE INVENTION

While avoiding the disadvantages which are inherent in the devices and methods indicated above, it is an object of the invention to recite a method which makes it possible to charge the coil of the printing hammer magnet with a braking pulse at the correct time so that the returning armature of the printing hammer magnet reaches its position of rest with a minimal kinetic energy.

To achieve this object it was assumed that printing hammer magnets, regardless of whether they are plunger-type or hinge- type armatures, show variable inductivity depending on the size of the air gap. The inductivity of the magnet system, in turn, determines the voltage increase. Thus it is possible to charge the coils of the print hammer magnet with measuring pulses while the armature is returning into its position of rest after printing, such measuring pulses having a specified pulse width and a specified pulse distance at a specified voltage. If the current flowing in the coil of the print hammer magnet is measured when the measuring pulse is switched on, an unmistakable connection between the amount of current and the width of the air gap and thus an unmistakable connection between the amount of current and the position of the armature on its way between printing and rest position results. A correctly timed charging of the coils of the printing hammer magnet with the braking pulse thus can be achieved by comparing the measured current with a reference current which corresponds to a defined position of the armature on its way back into its position of rest. Agreement between measured current and reference current then signals the reaching of this position and permits, if desired after a delay time, the triggering of the braking pulse at the correct time or on the correct path.

The advantage of the method according to the present invention thus consists in making it possible to sense the path of the returning print hammer magnet by the use of a simple voltage measuring and comparison method so that the conditions for charging the coil of the print hammer magnet with the braking pulse at the correct time and along the correct path are created. A path sensor, for example in the form of a photoelectric barrier, can thus be omitted, which results in a considerable savings in cost and space.

The further development of the present method makes it possible to determine the amount of time needed by the armature returning to its initial position for a certain distance on the path, this time permitting the drawing of conclusions regarding the present speed and thus the kinetic energy of the armature. This creates the conditions for varying of the moment when the braking pulse must be supplied to the coil of the printing hammer and, if required, the length of the braking pulse or the voltage curve of the braking pulse in dependence on the kinetic energy contained in the armature returning into its initial position, so that the speed of the returning armature is nearly zero when it reaches its position of rest. In this method for the exact metering of the braking impulse it is also possible to omit sensors, such as for example photoelectric barriers, so that the above mentioned advantages also apply here.

BRIEF DESCRIPTION OF THE DRAWINGS

An exemplary embodiment of the method in accordance with the invention is described in detail below by means of the drawings, given only by way of example, in which.

DETAILED DESCRIPTION OF A PREFERRED EMBODIMENT

Figure 1:
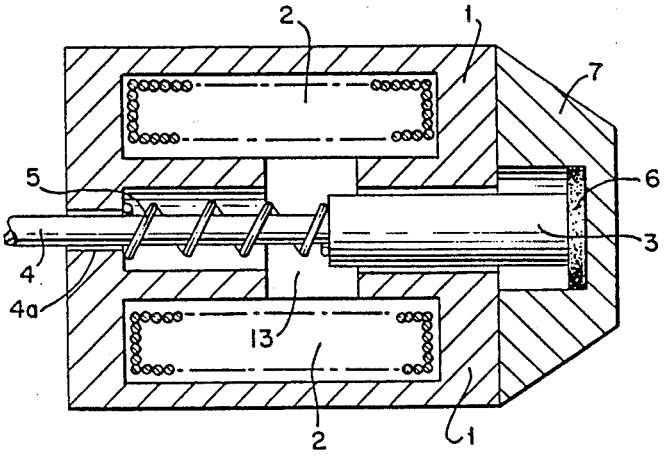
FIG. 1 illustrates a printing hammer magnet in a cross-sectional view.

FIG. 1 shows a print hammer magnet in a cross-sectional view. The yoke 1 of the print hammer magnet has a coil 2 in a recess and is also provided with a further recess in which the armature 3 is pivotably disposed. The armature 3 forms a working air gap 13 together with the yoke 1 and its front end is in the form of a tappet 4 which extends outwardly through a corresponding recess 4*a* in the yoke 1. By means of a spring 5 disposed on the tappet 4 and braced in the area of the recess 4*a* against the yoke 1, the armature 3 is retained in its position of rest and in this way rests via an elastic intermediate layer 6 against a rebound pan 7 fixed on the side of the yoke 1 which is opposite the recess 4*a*.

By supplying current to the coil 2, a magnetic field is created in the yoke 1 or the armature 3 which accelerates the armature 3 against the action of the spring 5 in the direction towards the recess 4*a*. If the air gap 13 is closed by the armature 3, the armature 3 moves in free flight. At this moment the current supply to the coil 2 has already been stopped. After the tappet 4 has struck a character (not shown) against the paper or the platen (also not shown), the armature is moved back into its initial position by the force of the spring 5. As already stated above, a renewed charging of the coil 2 of the print hammer magnet with a braking pulse takes place during the return of the armature 3 into its position of rest, so that the armature 3 has practically no kinetic energy when reaching its position of rest. To carry out the method for the rebound damping, the print hammer magnet, shown in FIG. 1 and described above, or its coil 2 is controlled by a circuit as shown in the form of a block diagram in FIG. 2. A programmable control unit, consisting of a microprocessor 8, a ROM 9 connected with it as well as a RAM 10 also connected with the microprocessor controls the coils 2 of the print hammer magnet via a drive circuit 11 in accordance with the program contained in the ROM 9. A current measuring circuit 12, the output of which is connected with the microprocessor 8, is disposed in the circuit of the print hammer magnet.

The operation of supplying of the print hammer magnet for the purpose of printing a character as well as the method for the rebound damping are described below with the aid of FIGS. 1 and 2 as well as the diagrams shown in FIG. 3, which show the voltage curve at the coil 2 of the print hammer magnet as well as the current flow at the coil 2 of the print hammer magnet. It is assumed that the character to be printed is in the printing position.

First the microprocessor 8 obtains information from the ROM 9 as to how long current is to be supplied to the coil 2 of the print hammer magnet in order to obtain a clear impression, and then supplies a voltage $U_1$ over a time $t_1$ to the coil 2 of the print hammer magnet via the driver 11. The voltage $U_1$ corresponds to a set value, the time $t_1$ depends on the size of the character and is derived by code conversion, via a table contained in the ROM, from the code which corresponds to the character in the print position. At the same time the driver 11 is activated, the microprocessor 8 starts a timer which, after a time $t_4$ which is longer than all occurring times $t_1$, triggers the sending of measuring pulses with which the microprocessor 8 again charges the driver 11. The measuring pulses fed to the coil 2 of the print hammer magnet by the driver 11 have, in the example chosen, a voltage $U_1$, the pulse width $t_7$ and the pulse distance $t_8$ are fixed in the control program. At each end of a measuring pulse the microprocessor 8 interrogates the current measuring circuit 12 and compares the measured value with a reference value $I_{ref\,2}$ contained in the control program. If there is agreement, the microprocessor starts a counter which counts the emitted measuring pulses and from this time on compares the measured value provided by the current measuring circuit 12 at the end of each measuring pulse with a reference value $I_{ref\,1}$. If there is agreement, the microprocessor 8 again starts a timer which, after a time $t_3$ specified in the control program, permits the charging of the coils of the print hammer magnet by the microprocessor 8 via the driver 11 with the braking pulse. The voltage of the braking pulse is, according to the illustration in FIG. 3, also equal to the voltage $U_1$. The time $t_2$ during which the braking pulse is applied to the coil 2 of the print hammer magnet depends on the number of measuring pulses counted by means of the counter from the time the reference value $I_{ref\,2}$ was reached until the time the reference value $I_{ref\,1}$ was reached. Translation of the count of the counter into the time $t_2$ is also performed by the microprocessor 8 during expiration of the time $t_3$ with the aid of a table disposed in the ROM 9.

In the example shown exact metering of the braking pulse is attained by translating the count of the counter which is proportional to the speed of the returning print hammer magnet and thus its kinetic energy into a time $t_2$. Of course, alternately to this there is the possibility to vary the time $t_3$, i.e. the moment of the switching on of the braking pulse, or the voltage applied to the coil 2 of the print hammer magnet during its charge with the braking pulse. Furthermore combinations of the possibilities discussed above are conceivable.

Figure 3:
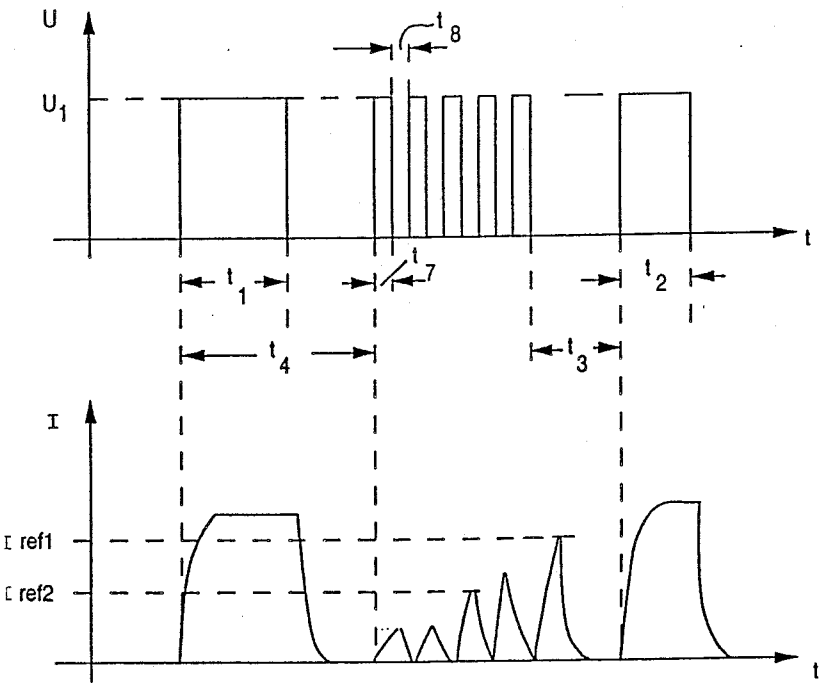
FIG. 3 is a diagram showing the voltage curve and a diagram showing the current flow in the course of a repulsion cycle.
Figure 4A:
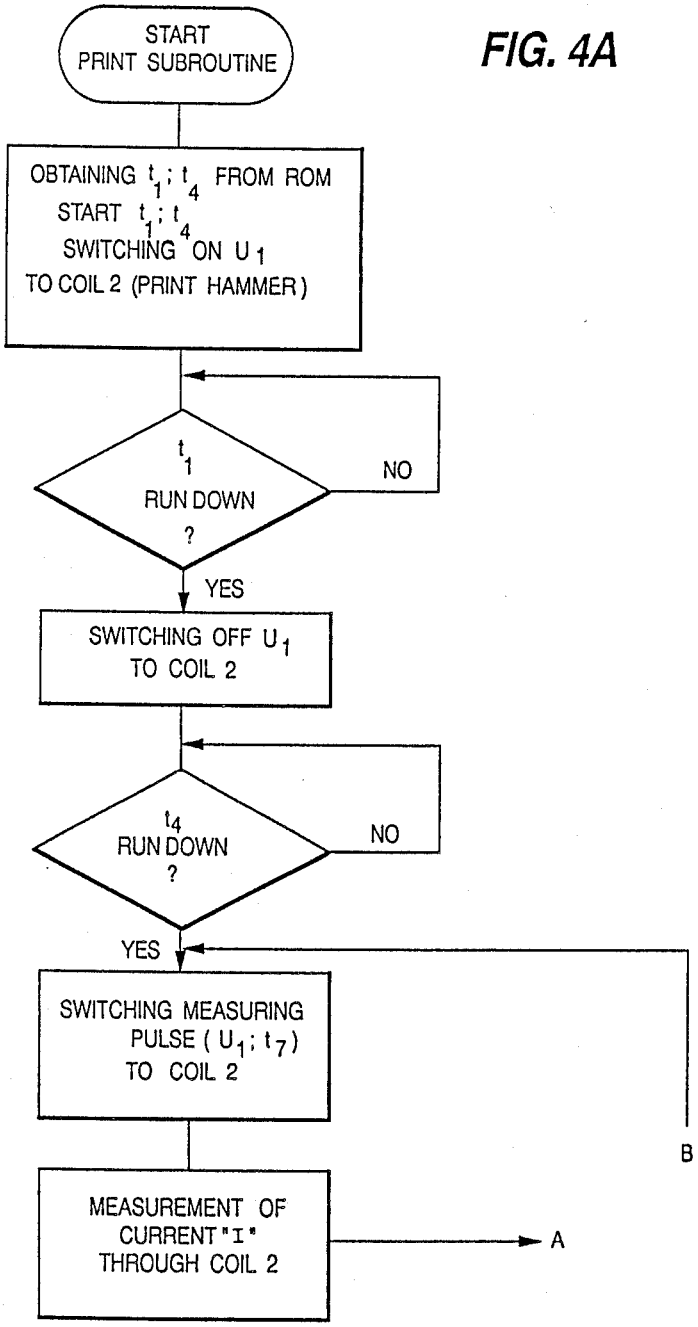
Figure 4B:
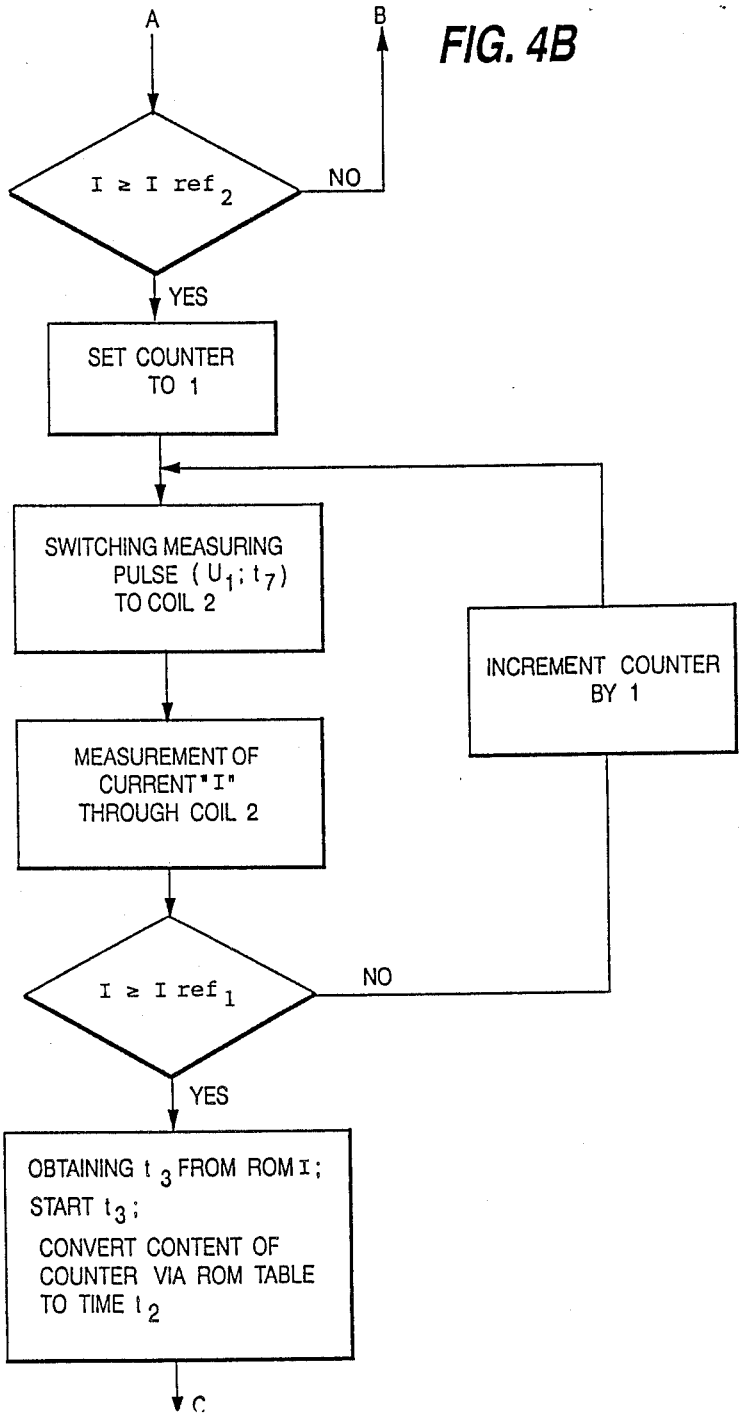

The times $t_1$ to $t_4$, mentioned in connection with FIG. 3, as well as the times $t_7$ and $t_8$ and the voltage $U_1$ are values which must be empirically determined depending on the mechanical conditions of a given printing hammer system, therefore no detailed information can be supplied here. The same is true, of course, for the determination of the reference values $I_{ref\,1}$ and $I_{ref\,2}$ which, as mentioned above, correspond to certain air gap widths and thus to a certain position of the armature of the printing hammer magnet returning into it initial position.

The timer mentioned in connection with the description of the method or the counter mentioned are, as is customary in such control devices, in the form of socalled software timer or socalled software counters. The operation of such timers and counters is sufficiently well known so that no further information is required here.

Figure 2:
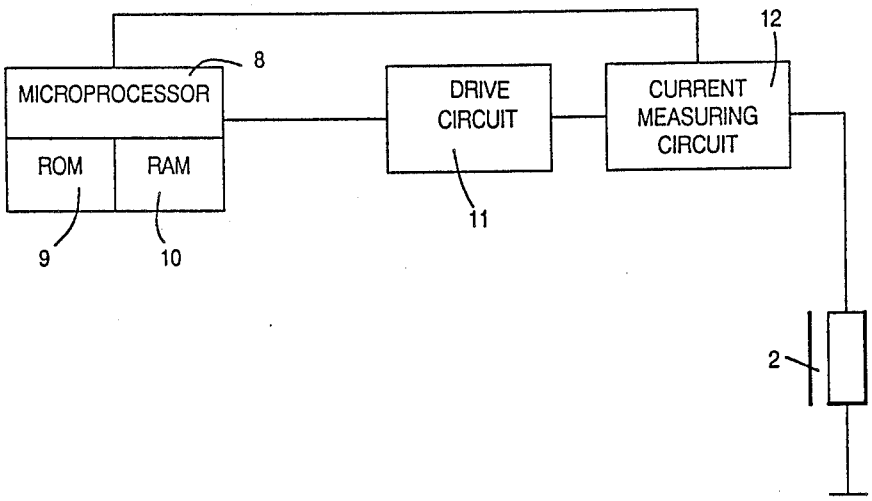
FIG. 2 is a block diagram of the circuit for carrying out the method according to the present invention.
Figure 4C:
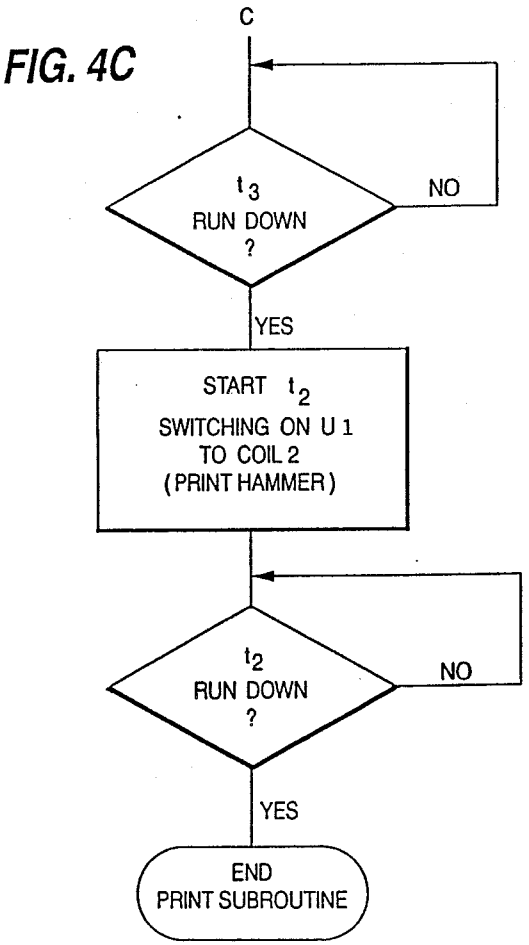
FIGS. 4A, 4B and 4C illustrate a flow chart of the print subroutine according to the present invention.

Finally it should be noted that in particular the printing hammer magnet shown in FIG. 1 and the circuit shown in FIG. 2 are only in the form of example. Other embodiments are conceivable with which one skilled in the art is familiar and thus do not require further explanation.

What is claimed is:

1. A method of damping the rebound of printing-hammer magnets in a typewriter, the typewriter comprising a programmable control unit, consisting of at least one microprocessor and memory means, wherein the impression of a type is effected by acting on the printing-hammer magnet with a predetermined first potential gradient over a predetermined first time and the damping of the rebound effect by a braking pulse with a predetermined second potential gradient over a predetermined second time, by means of the control unit, said control unit performing the steps of applying measuring pulses having a predetermined voltage, pulse width and pulse spacing to the winding of the printing hammer magnet during the impression of a character after the first time has elapsed;

measuring the current flowing through the winding of the printing hammer magnet during each of said measuring pulses by means of a current measuring circuit and comparing it with a reference value;

presetting a third time when the reference value is reached; and after the third time has elapsed, applying the predetermined second potential gradient to the winding of the printing-hammer magnet during the predetermined second time.

2. A method according to claim 1, wherein a further reference value is provided which is smaller than the first reference value and the control unit performs the step of detecting the time between the reaching of the further reference value and the first reference value; and presetting the third time depending on the time detected and/or varying the second time and/or the second potential gradient applied to the winding of the printing-hammer magnet during the braking pulse, depending on the time detected.

* * * * *